US008579114B2

(12) United States Patent
Gringer et al.

(10) Patent No.: US 8,579,114 B2
(45) Date of Patent: Nov. 12, 2013

(54) PACKAGING DEVICE

(75) Inventors: Donald Gringer, New York, NY (US); Yuan Fang Cheng, Forest Hills, NY (US)

(73) Assignee: Allway Tools, Inc., Bronx, NY (US)

( * ) Notice: Subject to any disclaimer, the term of this patent is extended or adjusted under 35 U.S.C. 154(b) by 0 days.

(21) Appl. No.: 12/944,553

(22) Filed: Nov. 11, 2010

(65) Prior Publication Data

US 2012/0118776 A1 May 17, 2012

(51) Int. Cl.
*B65D 83/10* (2006.01)

(52) U.S. Cl.
USPC ..... 206/361; 206/806

(58) Field of Classification Search
USPC ..... 206/361, 209, 495, 564, 562, 806, 494, 206/461, 471; 220/736, 752, 771, 751, 220/212.5; 215/399; 292/246; 383/9, 24, 383/61.2
See application file for complete search history.

(56) References Cited

U.S. PATENT DOCUMENTS

| | | | | |
|---|---|---|---|---|
| 1,455,803 | A * | 5/1923 | Nofsinger | 224/239 |
| 1,869,753 | A * | 8/1932 | Kamm | 206/361 |
| 1,872,827 | A * | 8/1932 | Searles | 206/361 |
| 4,359,158 | A | 11/1982 | Gringer | |
| 5,456,382 | A * | 10/1995 | Gringer | 221/257 |
| 6,490,767 | B2 * | 12/2002 | Haiduk | 24/298 |
| 6,757,931 | B2 * | 7/2004 | Nordstrom | 15/248.1 |
| 2001/0047948 | A1 * | 12/2001 | Cummings et al. | 206/362.4 |
| 2002/0092789 | A1 * | 7/2002 | Sauer et al. | 206/494 |
| 2002/0112982 | A1 * | 8/2002 | Stagray et al. | 206/494 |
| 2007/0295771 | A1 * | 12/2007 | Herbig et al. | 224/191 |
| 2008/0047078 | A1 * | 2/2008 | Gully | 8/158 |
| 2009/0236341 | A1 * | 9/2009 | McKinney et al. | 220/375 |

* cited by examiner

*Primary Examiner* — Luan K Bui
*Assistant Examiner* — Rafael Ortiz
(74) *Attorney, Agent, or Firm* — Gottlieb, Rackman & Reisman, P.C.

(57) ABSTRACT

There is provided in a preferred embodiment of the present invention an improved packaging device comprising a plastic casing having a depressed compartment, a plurality of wings extending from the plastic casing and a connector to secure the wings of the plastic casing around the product. Preferably, the improved packaging device also includes a folding hanger that extends from the proximate end of the plastic casing, and is used to display the product.

4 Claims, 7 Drawing Sheets

PACKAGING DEVICE

FIELD OF THE INVENTION

This invention relates generally to the field of packaging devices. More specifically, this invention involves an efficient and effective blister packaging unit for a product having an abrasive or sharp element. In a preferred embodiment, the packaging device is constructed of a clear plastic and includes a compartment for shielding the abrasive element typically found on a hand-held tool.

BACKGROUND OF THE INVENTION

Conventional blister packaging has been in existence for many years. Generally, blister packaging consists of a thin flexible plastic which forms a cavity within which a product is located. The plastic cavity is typically sealed with a thin sheet of coated cardboard, paper or clear plastic. Blister packaging typically envelops the entire product, allowing a consumer to view, but not contact, the contents of the package.

There are several problems associated with existing blister packaging. For example, blister packaging that incorporates relatively hard plastic is difficult to open, often requiring the use of a sharp blade or a scissors to cut and/or penetrate the packaging. Further, covering an entire product with blister packaging significantly increases the overall cost of the product by virtue of the increases in manufacturing costs (because more plastic must be utilized to create the finished product) and in shipping cost (because the overall volume of the product is increased).

Another prevalent problem is that certain classes of products, particularly tools which have exposed abrasive and/or sharp elements (e.g., brushes with wire bristles, utility knives with cutting blades), are typically sold without any protective packaging. While consumers usually take extra precautions when purchasing and handling these products, there is the potential for the exposed abrasive or sharp points to cause harm to unwary consumers, as well as damage adjacent unprotected products.

SUMMARY OF THE INVENTION

In view of the deficiencies and drawbacks in the prior art, it is a primary object of the present invention to provide an improved packaging device that shields abrasive and/or sharp elements of a product without significantly increasing the volume of the product.

Another object of the present invention is to provide an improved packaging device that is relatively thin, yet effectively shields the abrasive and/or sharp elements of a product from external contact.

A further object of the present invention is to provide a packaging device that is easy to open as compared to other blister packed products.

Additional objectives will be apparent from the description of the invention that follows.

In summary, there is provided in a preferred embodiment of the present invention an improved packaging device comprising a plastic casing having a depressed compartment for enclosing the working end of a product, such as an abrasive, bristled head of a hand-held tool, a plurality of wings or ears extending laterally from the plastic casing and a connector to secure the wings of the plastic casing to the tool. In a preferred embodiment, the packaging device also includes a folding hanger that extends from the forward or proximate end of the plastic casing, where the folding hanger supports the weight of the packaging device and product.

BRIEF DESCRIPTION OF THE DRAWINGS

The above-described and other advantages and features of the present disclosure will be appreciated and understood by those skilled in the art from the following detailed description and drawings of which.

DETAILED DESCRIPTION OF THE INVENTION

Figure 1:
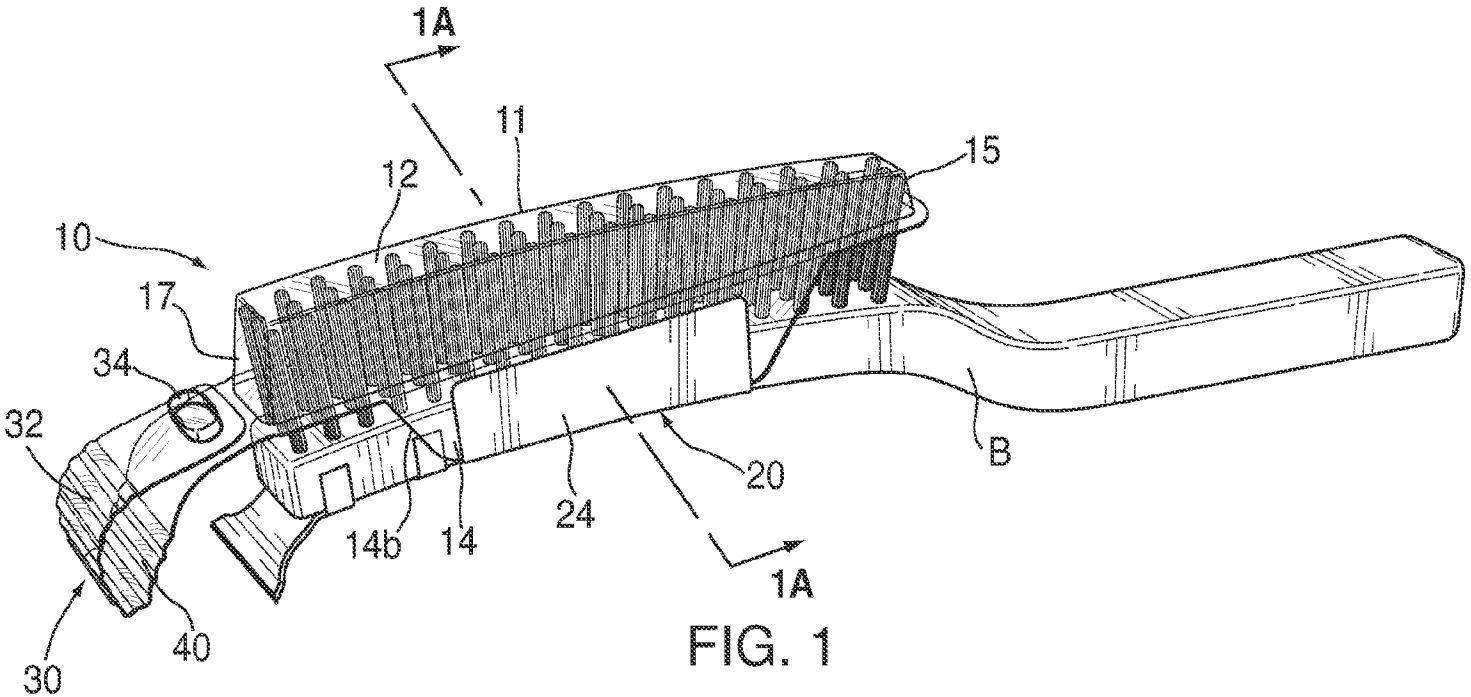
FIG. 1 is a perspective view of a first preferred embodiment of the packaging device of the present invention engaged to a brush.
Figure 2:
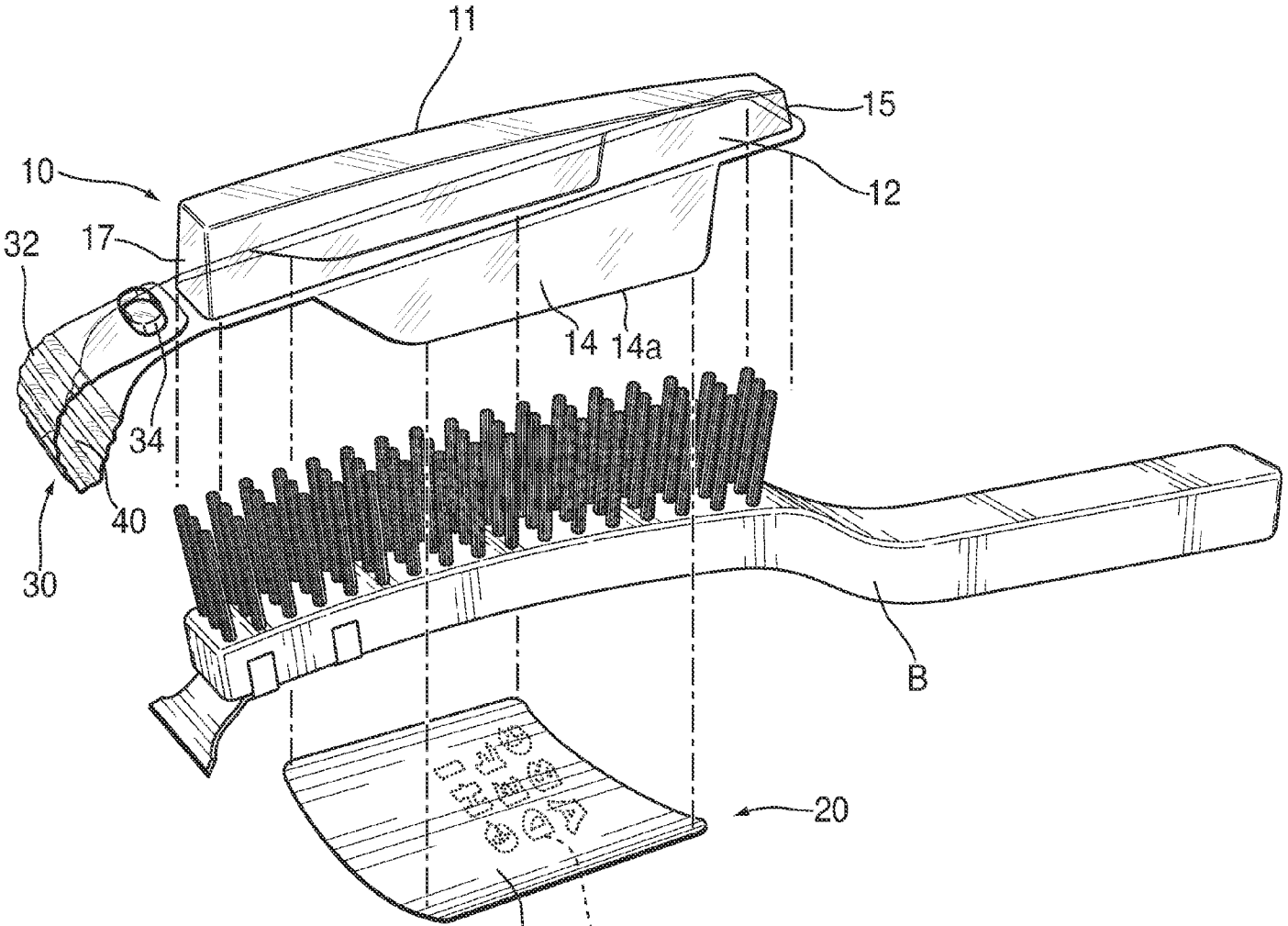
FIG. 2 is an exploded view thereof, showing the brush positioned between the plastic casing and a connector of the packaging device.
Figure 3:
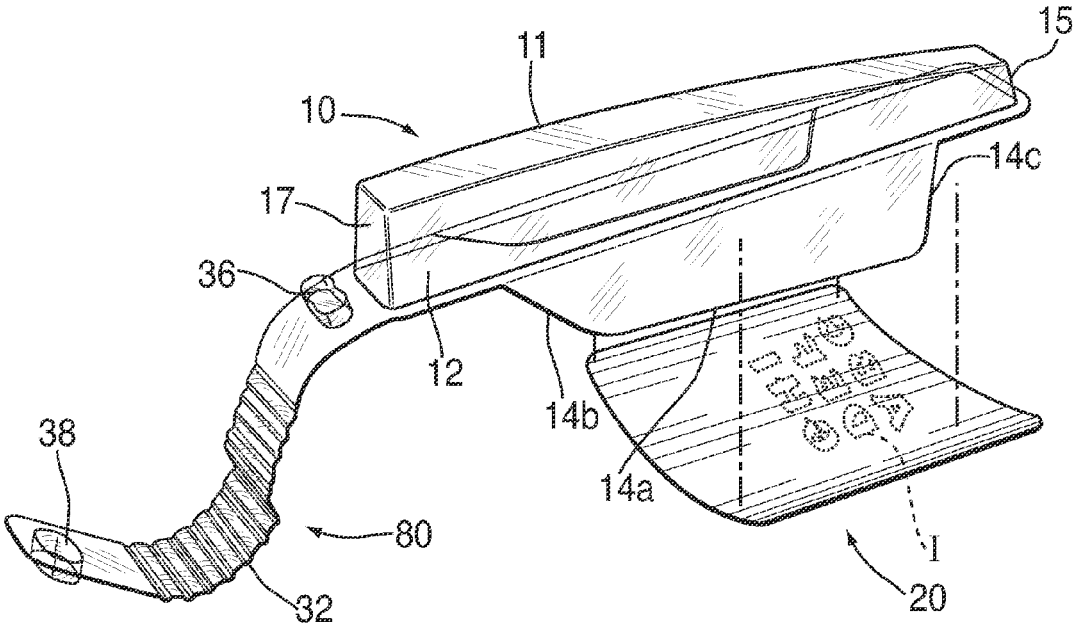
FIG. 3 is a perspective view of the first preferred embodiment packaging device shown in FIG. 1, but prior to engaging a brush.

With reference to FIGS. 1 through 3, there is shown a first preferred embodiment of a packaging device 10 of the present invention. Packaging device 10 is sized and adapted to be used in conjunction with a hand-held brush B having a plurality of sharp or abrasive, wire bristles. The packaging device 10 is composed of a plastic casing 11 that includes a depressed cavity or hollow compartment 12. The interior length dimension and interior width dimension of the compartment 12 each generally conform to the exterior length dimension and exterior width dimension, respectively, formed by the outer clusters of bristles on brush B, allowing the packaging device to be comfortably placed over the wire bristles but with little room between the interior surface of the compartment 12 and the bristles.

The depth of compartment 12 varies from the rearward or distal end 15 of the plastic casing 11, where compartment 12 is shallower, to the forward or proximate end 17 of the plastic casing 11, where the compartment 12 is deeper. Despite the change in depth along the length of the compartment 12, all of the bristles of brush B are fully protected from causing damage to consumers or other products situated nearby. In this particular embodiment, the change in depth of the compartment 12 effectively allows hanger 30 (discussed in more detail below) to be centrally positioned. This permits a generally even distribution when the packaging device 10 and brush B are hung together for display.

Although the compartment presented in FIGS. 1 through 3 is of a particular configuration designed to accommodate the bristles, body and handle of brush B, it should be understood in the context of all embodiments of the present invention that the interior space should be of sufficient area and volume to effectively accommodate and shield any other elements of a product which are capable of causing damage or injury by casual contact.

Packaging device 10 further includes, desirably, two wings or ears 14, 14 extending laterally from compartment 12, the wings desirably being integral with the remainder of the compartment. Preferably, wings 14, 14 extend sufficiently to cover at least a portion of the body of brush B, each wing 14 including a central extended portion 14*a* and a pair of diagonally extending front and rear portions 14*b* and 14*c*. Connector 20 secures wings 14, 14 in a closed position, thereby securing packaging device 10 to brush B. As shown in FIGS. 1 through 3, connector 20 comprises a label with an innermost adhesive side 22 and an outermost information side 24, where a conventional adhesive is used to adhere the adhesive side 22 to both wings 14, 14 and to the exterior of brush B thus securing the packaging device 10 and leaving information side 24 of the connector 20 exposed for display. The information side 24 typically includes information I pertaining to the product including but not limited to the name of the product, the seller of the product, the price of the product, the uses for the product, the ISBN (bar code) of the product and/or other relevant information. The compartment 12 leaves major portions of the brush B uncovered and exposed to the touch of a consumer.

Figure 1B:
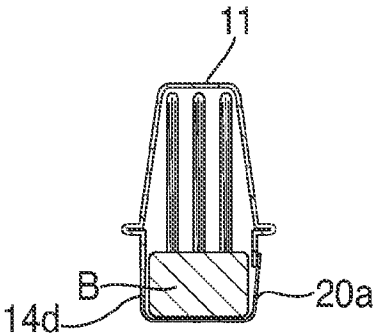
FIG. 1B is a cross-section view of alternative embodiment including a single wing.
Figure 1A:
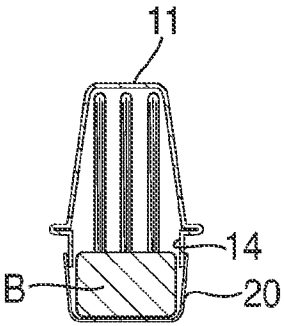
FIG. 1A is a cross-section view of the first preferred embodiment of FIG. 1.

In an alternate embodiment, only a single wing is incorporated into the packaging device. This embodiment is shown only in FIG. 1B. In the single-wing embodiment, the packaging device incorporates a single wing 14*d* that wraps entirely around the body of the brush and is fastened with a connector 20*a* such as glue bead.

Packaging device 10 further includes an elongated hanger 30 positioned at the proximate end 17 of the plastic casing 11. Hanger 30 comprises a plurality of hanger ribs 32 that enable hanger 30 to fold and bend on itself as needed to permit display of packaging device 10 in a consumer setting. Hanger 30 also incorporates a hanger lock 34 to enable itself to permanent "loop", that is comprised of a male protruding end 36 and a female receiving end 38 that frictionally engage one another in a snap-fit and create a loop 40. See FIG. 1, illustrating the lock 34. FIG. 3 depicts packaging device 10 with hanger lock 34 disengaged. When the lock 34 is in the disengaged position, hanger 30 comprises an elongated strip of plastic with the male end 36 positioned adjacent to blister compartment 12. When closed, the hanger 30 may hang the entire unit on a conventional display unit in a retail store.

Packaging device 10 is preferably constructed of clear flexible plastic such as PET or PVC but other conventional materials known in the art may be utilized as a suitable alternative. The thickness of plastic should be sufficient to prevent penetration from a sharp or abrasive bristle. However, the thickness should be kept to a minimum to ensure low cost and weight, and flexibility of the unit as a whole.

The preferred manner for attaching Packaging device 10 to brush B is as follows. Packaging device 10 is positioned above brush B as shown in FIG. 2. Packaging device is lowed onto brush B with compartment 12 covering the wire bristles of brush B and wings 14 covering the sides of the body of brush B. Then connector 20 is adhered to the side of brush B opposite the wire the bristles such that connector 20 is folded to adhere to wings 14 in addition to brush B.

Figure 4:
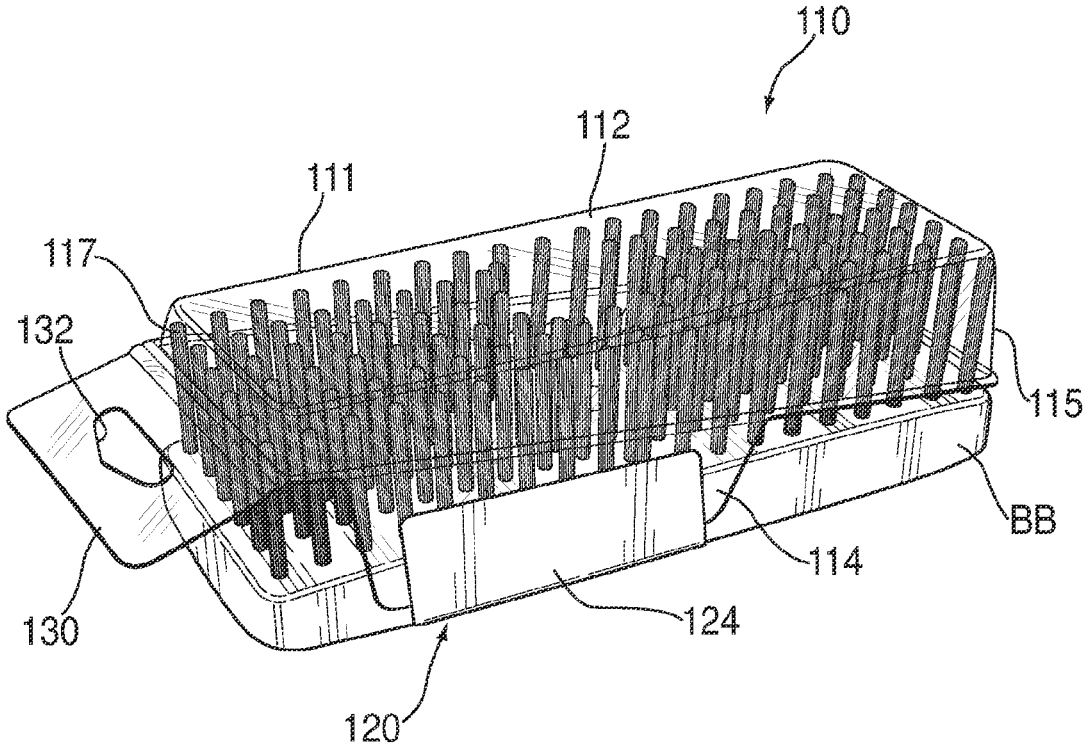
FIG. 4 is a perspective view of a second preferred embodiment of the packaging device of the present invention engaged to a brush.
Figure 5:
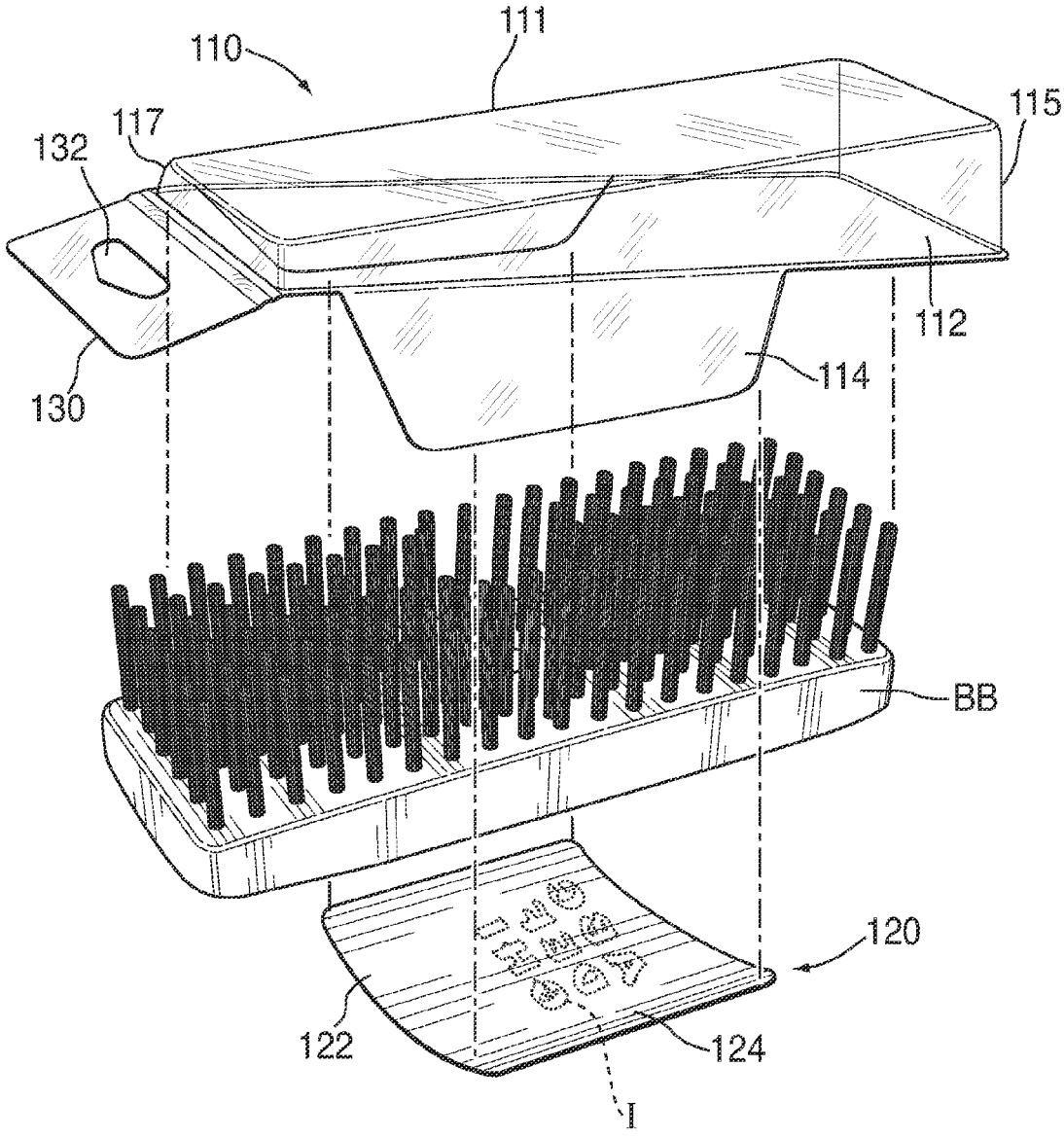
FIG. 5 is an exploded view thereof, showing the brush positioned between the plastic casing and the connector of the packaging device.

Referring to FIGS. 4 through 5, there is shown a second preferred embodiment of packaging device 110 of the present invention. Packaging device 110 is a variation of packaging device 10 and is designed to be used in conjunction with a larger and wider hand-held brush BB. As previously discussed, brush BB includes a plurality of sharp or abrasive, wire bristles. Packaging device 110 is composed of a plastic casing 111 that includes a depressed interior cavity or compartment 112. As with the first embodiment, the interior length and width dimensions of compartment 112 conform to the exterior length and width dimensions, respectively, formed by the outer clusters of bristles on brush BB. The conformance of the interior of compartment 112 to the exterior of the outer cluster of bristles allows the packaging device 110 to be comfortably placed over the cluster of bristles. Packaging device 110 further includes a hanger 130, with a slot 132, positioned at the proximate end 117 of the plastic casing 111, for hanging in a store.

The depth of compartment 112 varies from the rearward or distal end 115 of the plastic casing 111, where the compartment is deeper, to the forward or proximate end 117 of the plastic casing 111, where the compartment is shallower. The varying depth of the compartment 112 allows the compartment to fully protect the bristles of brush BB while properly balancing the packaging device 110 and brush BB when hung together for display.

Moreover, in this embodiment, varying the depth of the compartment 112 enables more efficient positioning of the hanger 130 relative to a display wall on which the packaging device 110 is displayed and/or from which the packaging device 110 is suspended. In most instances, the depth of the compartment is varied to allow the hanger 130 to be positioned closer to the bottom of the bristles of the brush BB (and hence closer to the display wall), and preferably no further than midway between the bottom bristles of the brush and the top surface of the handle. While the hanger 130 in this embodiment is positioned closer to the bottom surface of the bristles, it should be understood that the position of the hanger (and the depth of the compartment) may be varied to accommodate and balance a wide variety of objects having different components with different weight configurations and densities.

Although the compartment presented in FIGS. 4 through 5 is of a particular configuration designed to accommodate the bristles, body and handle of brush BB, it should be understood in the context of all embodiments of the present invention that the interior space should be of sufficient area and volume to effectively accommodate and shield any other elements of a product which are capable of causing damage by casual contact.

Packaging device 110 further includes two wings or ears 114, 114 extending laterally from compartment 112 and a connector 120. Preferably wings 114, 114 extend sufficiently downward to cover at least a portion of the body of brush BB. Connector 120, similarly to connector 20 in FIGS. 1 through 3, secures wings 114, 114 in a closed position, thereby securing packaging device 110 to brush BB. As shown in FIGS. 4 and 5, connector 120 comprises a label with an adhesive innermost side 122 and an outermost information side 124, where the adhesive side adheres to both wings 114, 114 and to the lower exterior of brush BB thus securing the packaging device 110 and leaving information side 124 at I exposed for display. The information side 124 has information thereon and is consistent with information side 24, described above.

Additionally, and consistent with the first embodiment, wings 114, 114 may be formed in multiple alternate embodiments. Wings 114, 114 may collectively wrap around the body of brush BB and directly contact one another. Here, a connector may also be integrated into the wings at the point of contact thereof to form a fastener. In another alternate embodiment, only a single wing is incorporated into the packaging device. In the single-wing embodiment, the packaging device incorporates a single wing that wraps entirely around the body of the brush and is fastened with a connector.

Figures 6, 6A:
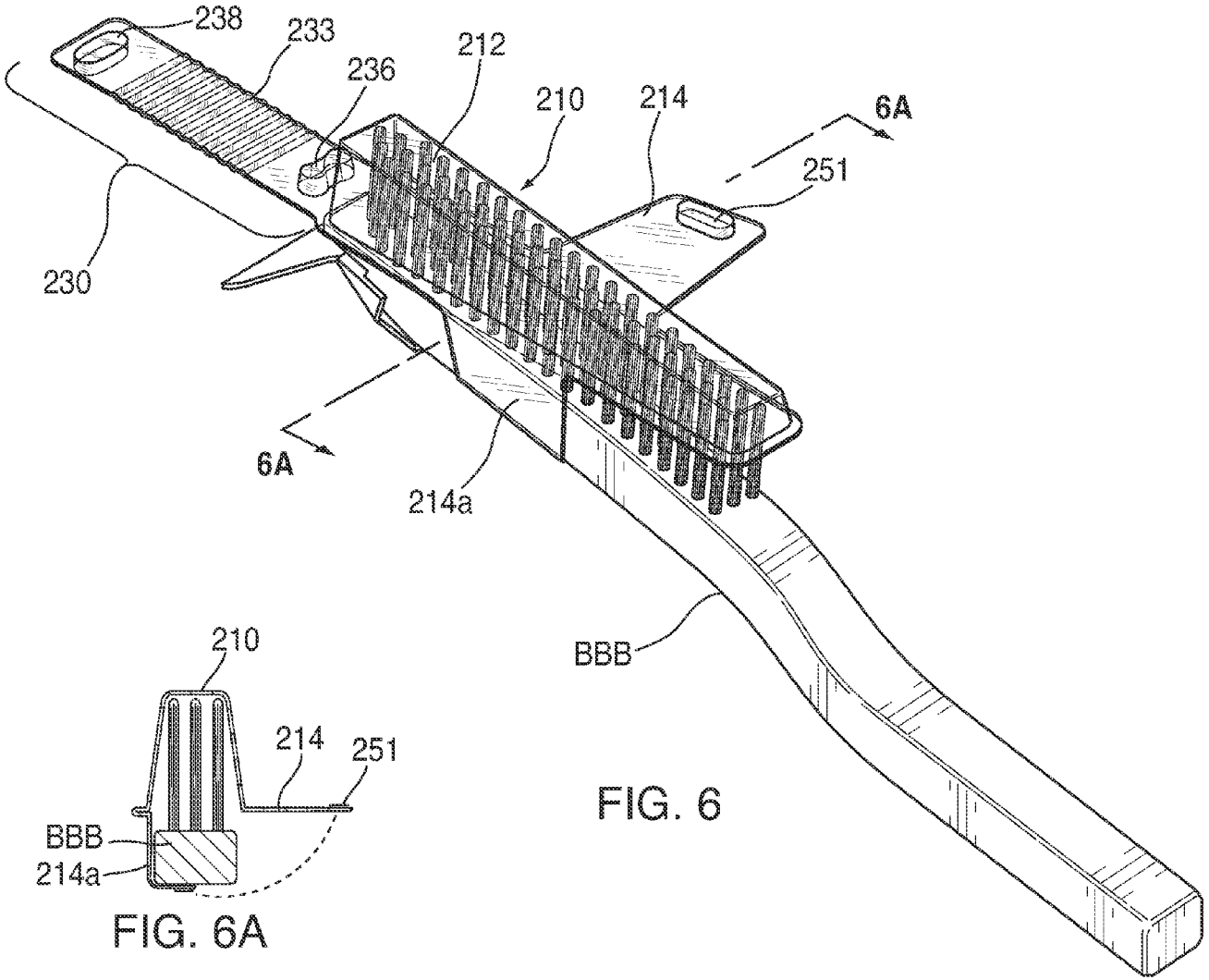
FIG. 6 is a perspective view of a third preferred embodiment of the packaging device of the present invention engaged to a brush.
FIG. 6A is a cross-section view of the third preferred embodiment of the packaging device of the present invention.
Figure 7:
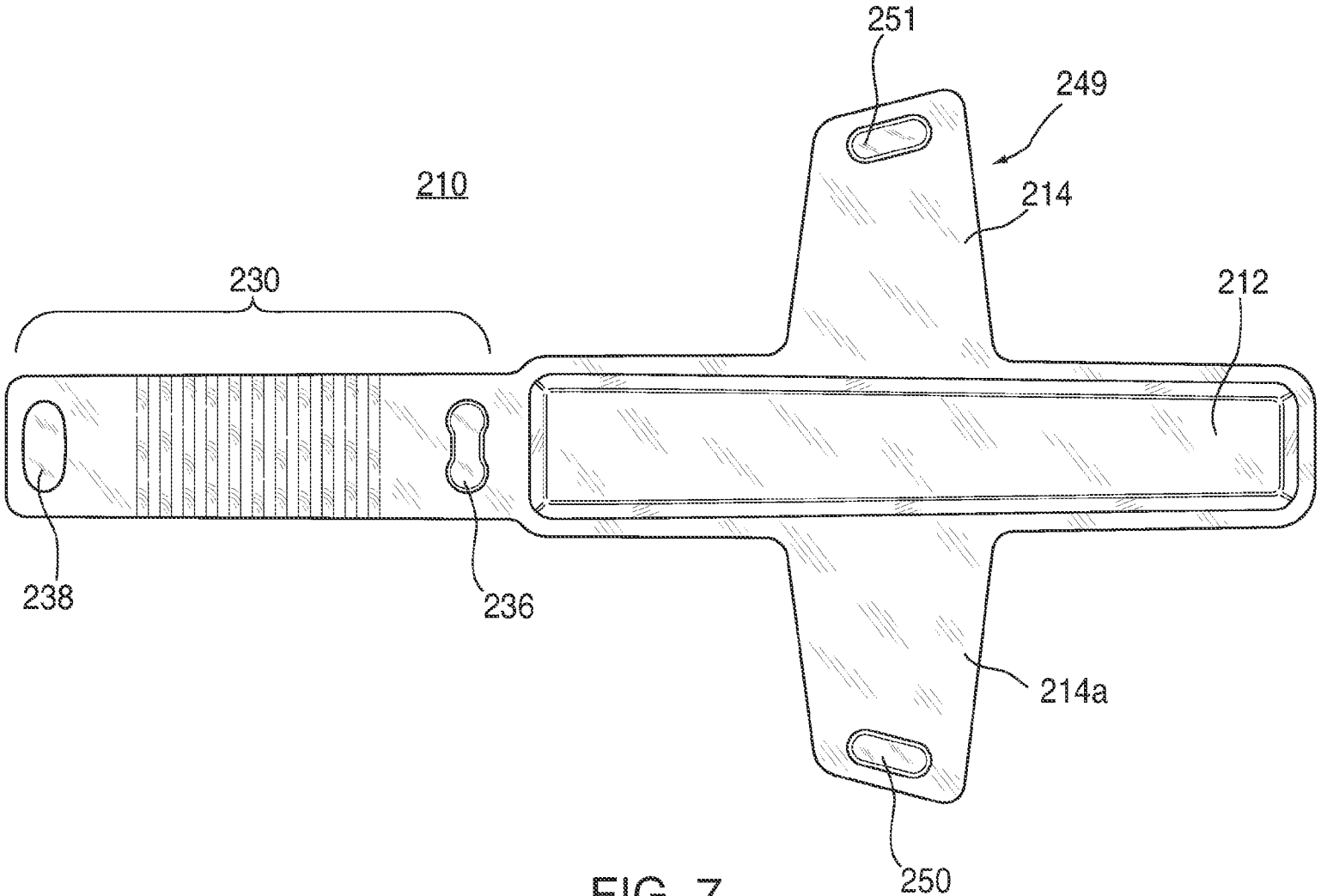
FIG. 7 is a top view of the third preferred embodiment of the packaging device of the present invention.

Referring to FIGS. 6, 6A and 7, there is shown a third preferred embodiment of the packaging device 210 of the present invention. Packaging device 210 is a variation of packaging devices 10, 110. Packaging device 210 includes blister compartment 212, hanger 230 and wings 214, 214*a*. Compartment 212 and hanger 230 are identical to compartment 12 and hanger 30, while wings 214, 214*a* comprise a variation from wings 14, 14 and wings 114, 114.

Wings 214, 214*a* wrap fully around the body of a brush BBB. Wings 214, 214*a* differ from the previous two preferred embodiments in that wings 214, 214*a* include a lock composed of a female component 250 and a male component 251, respectively. Further, wings 214, 214*a* are of sufficient length to wrap around the body of brush BBB and connect to each other. At the location of the connection of wings 214, 214*a*, female component 250 and male component 251 are capable of locking together to form a snap-fit lock connector that secures packaging device 210 to brush BBB. In alternative embodiments, the snap-fit lock connector may be an adhesive connector or a slot-and-hook connector.

In addition to its effectiveness as a package for a brush with abrasive wire bristle tips, the packaging device 10, 110, 210 of the present invention is beneficial because multiple packaging devices 10, 110, 210 can be stacked on top of each other for condensed storage and shipping. As illustrated in FIG. 3, blister compartment 12 is tapered such that its opening is its widest area. Accordingly, a plurality of packaging device 10, 110 can be stacked on top of each other with the blister compartment 12, 112, 212 fitting into a blister compartment 12, 112, 212 of an adjacent packaging device 10, 110, 210.

The accompanying drawings only illustrate several embodiments of a packaging device and their respective constituent parts, however, other types and styles are possible, and the drawings are not intended to be limiting in that regard. Thus, although the description above and accompanying drawings contains much specificity, the details provided should not be construed as limiting the scope of the embodiments but merely as providing illustrations of some of the presently preferred embodiments. The drawings and the description are not to be taken as restrictive on the scope of the embodiments and are understood as broad and general teachings in accordance with the present invention. While the present embodiments of the invention have been described using specific terms, such description is for present illustrative purposes only, and it is to be understood that modifications and variations to such embodiments, including but not limited to the substitutions of equivalent features, materials, or parts, and the reversal of various features thereof, may be practiced by those of ordinary skill in the art without departing from the spirit and scope of the invention.

The invention claimed is:

1. A packaging device for a brush, said brush having a body holding abrasive bristles and a handle, said packaging device comprising:

a plastic casing having a depressed compartment, said compartment sized and adapted to accommodate said abrasive bristles of said brush and exposing at least a portion of said body and said handle;

a pair of wings extending from said depressed compartment, said wings sized to cover at least a portion of said body of said brush, wherein said wings are parallel to the longitudinal side walls of said compartment;

a connector, said connector attached to said pair of wings and around said body of said brush to maintain said bristles in said compartment;

a hanger positioned at said proximate end of said plastic casing, said hanger including a lock, wherein said hanger and said lock are constructed from a singular piece of plastic; and an adhesive side of said connector, wherein said adhesive side of said connector is affixed to said brush;

wherein said plastic casing exposes a portion of the body and a portion of the abrasive bristles.

2. The packaging device of claim 1, wherein said compartment has a distal end and a proximate end, and the depth of said compartment varies from the distal end to the proximate end.

3. The packaging device of claim 2, wherein said distal end has a greater depth than said proximate end.

4. The packaging device of claim 2, wherein said proximate end has a greater depth than said distal end.

* * * * *